US008966943B2

(12) United States Patent
Ryu et al.

(10) Patent No.: US 8,966,943 B2
(45) Date of Patent: Mar. 3, 2015

(54) LAUNDRY TREATING APPARATUS WITH A ROTATABLE WATER SUPPLY PART

(75) Inventors: Seung Gyu Ryu, Busan (KR); Chang Gyu Choi, Kimhae-si (KR); Hye Yong Park, Changwon-si (KR); Jung Wook Moon, Kimhae-si (KR); Kwang Hee Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1007 days.

(21) Appl. No.: 13/003,838

(22) PCT Filed: Jul. 13, 2009

(86) PCT No.: PCT/KR2009/003820

§ 371 (c)(1), (2), (4) Date: Feb. 24, 2011

(87) PCT Pub. No.: WO2010/008162

PCT Pub. Date: Jan. 21, 2010

(65) Prior Publication Data

US 2011/0174022 A1 Jul. 21, 2011

(30) Foreign Application Priority Data

Jul. 14, 2008 (KR) ..... 10-2008-0067943
Jul. 14, 2008 (KR) ..... 10-2008-0067944

(51) Int. Cl.
*D06F 39/00* (2006.01)
*D06F 39/08* (2006.01)
*D06F 58/10* (2006.01)

(52) U.S. Cl.
CPC ..... *D06F 58/10* (2013.01)
USPC ..... 68/5 C; 68/5 R; 68/222

(58) Field of Classification Search
CPC ..... D06F 73/00; D06F 73/02; D06F 39/008; D06F 39/088; D06F 39/08; D06F 2202/08; D06F 2204/086
USPC ..... 68/5 C, 205 R, 6
See application file for complete search history.

(56) References Cited

U.S. PATENT DOCUMENTS

| | | | | |
|---|---|---|---|---|
| 7,305,856 | B2 * | 12/2007 | Bolduan et al. | 68/5 C |
| 2008/0155758 | A1 * | 7/2008 | Hong et al. | 8/149.3 |

FOREIGN PATENT DOCUMENTS

| | | | |
|---|---|---|---|
| CN | 1966831 | | 5/2007 |
| EP | 1 932 963 | A1 | 6/2008 |
| KR | 10-2007-0025660 | A | 3/2007 |
| KR | 10-2007-0105580 | A | 10/2007 |
| WO | 2005-001191 | A1 | 1/2005 |
| WO | 2006100335 | A1 | 9/2006 |
| WO | WO 2007/145432 | A1 | 12/2007 |
| WO | WO 2008/004802 | A2 | 1/2008 |
| WO | WO/2009/020313 | A2 * | 2/2009 |

* cited by examiner

*Primary Examiner* — Michael Barr
*Assistant Examiner* — Irina Graf
(74) *Attorney, Agent, or Firm* — McKenna Long & Aldridge LLP

(57) ABSTRACT

A laundry treating apparatus (100) includes a cabinet (10) comprising accommodating space (12) receiving laundry (1), a hot air supply device (22) supplying hot air to the accommodating space (12), a steam generating device (30) supplying steam to the accommodating space (12), a water supply part (60) rotatably provided in a predetermined portion of the cabinet (10), the water supply part (60) receiving water supplied to the steam generating device (30), and a water supply unit (80) allowing water to be supplied to the steam generating device (30) from the water supply part (60) as the water supply part is rotated.

16 Claims, 3 Drawing Sheets

LAUNDRY TREATING APPARATUS WITH A ROTATABLE WATER SUPPLY PART

This application is a 35 U.S.C. §371 National Stage entry of International Application No. PCT/KR2009/003820, filed on Jul. 13, 2009, and claims priority to Korean Application Nos. KR 10-2008-0067943, filed on Jul. 14, 2008 and KR 10-2008-0067944, filed Jul. 14, 2008, all of which are hereby incorporated by reference in their entireties as if fully set forth herein.

TECHNICAL FIELD

The present invention relates to a laundry treating apparatus.

BACKGROUND ART

In recent, various kinds of laundry treating apparatus have been consumed together with washing machines for washing laundry. For example, the various kinds are drum-type dryers for drying laundry having being washed and cabinet-type dryers for drying laundry hung thereon and refreshers for refreshing laundry by supplying hot air to the laundry, which are still under development.

DISCLOSURE OF INVENTION

Technical Problem

The present invention is directed to a laundry treating apparatus capable of refreshing laundry by supplying hot air or steam to laundry therein.

An object of the present invention is to provide a laundry treating apparatus capable of refreshing laundry more efficiently.

Solution to Problem

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treating apparatus includes a cabinet comprising accommodating space receiving laundry; a hot air supply device supplying hot air to the accommodating space; a steam generating device supplying steam to the accommodating space; a water supply part rotatably provided in a predetermined portion of the cabinet, the water supply part receiving water supplied to the steam generating device; and a water supply unit allowing water to be supplied to the steam generating device from the water supply part as the water supply part is rotated.

The water supply part may include a water supply source storing the water supplied to the steam generating device; and a case rotatably provided with the cabinet, the case comprising seating space seating the water supply source therein.

The hot supply device may include a heat pump heating air and removing moisture contained in the air and the case further comprises water collecting space collecting condensed water from the heat pump.

The case may include a body panel where the seating space and the water collecting space are provided and a front panel forming a predetermined portion of a front surface of the cabinet, the front panel formed integrally with the body panel.

The water supply source may include a water inlet through which the water stored in the water supply source is supplied to the steam generating device and the water supply unit is provided in the water inlet.

The water inlet may be perpendicularly provided in a bottom of the water supply source.

The water supply unit may open the water inlet if the water supply part is rotated to be seated in the cabinet and the water supply unit may close the water inlet if the water supply part is rotated to be separated from the cabinet.

The water supply unit may include a sealing member movable a predetermined distance to open and close the water inlet; an elastic member applying elasticity to the sealing member; and a supporting bar selectively pressing the sealing member according to the rotation of the water supply part.

The supporting bar may be provided in the sealing member.

The laundry treating apparatus may further include intermediary space provided between the water supply part and the steam generating device, the intermediary space temporarily storing water supplied from the water supply source before supplied to the steam generating device.

The supporting bar may be provided in a predetermined portion of the intermediary space.

The intermediary space may be provided in the cabinet substantially higher than the steam generating device.

The laundry treating apparatus may further include a valve (V) provided between the steam generating device and the intermediary space, the valve (V) adjusting the amount of water supplied to the steam generating device.

The laundry treating apparatus may further include a pump fP) pumping the water stored in the intermediary space into the steam generating device.

The laundry treating apparatus may further include a guide unit guiding the water supply part if the water supply part is rotated.

The guide unit may include a housing having a guide groove guiding the motion of the water supply part formed therein and a guide bar provided in the water supply part, the guide bar corresponding to the guide groove.

the guide groove may be provided in one side or both sides of the housing, along the rotation of the of the water supply part.

The guide groove may be formed in an arc shape having a predetermined semi-diameter or a curvature shape.

It is to be understood that both the foregoing general description and the following detailed description of the present invention are exemplary and explanatory and are intended to provide further explanation of the invention as claimed.

Advantageous Effects of Invention

The laundry treating apparatus according to the present invention can supply water because the water supply unit supplying water to the steam generating device is provided above the steam generating device.

BRIEF DESCRIPTION OF DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

Figure 1:
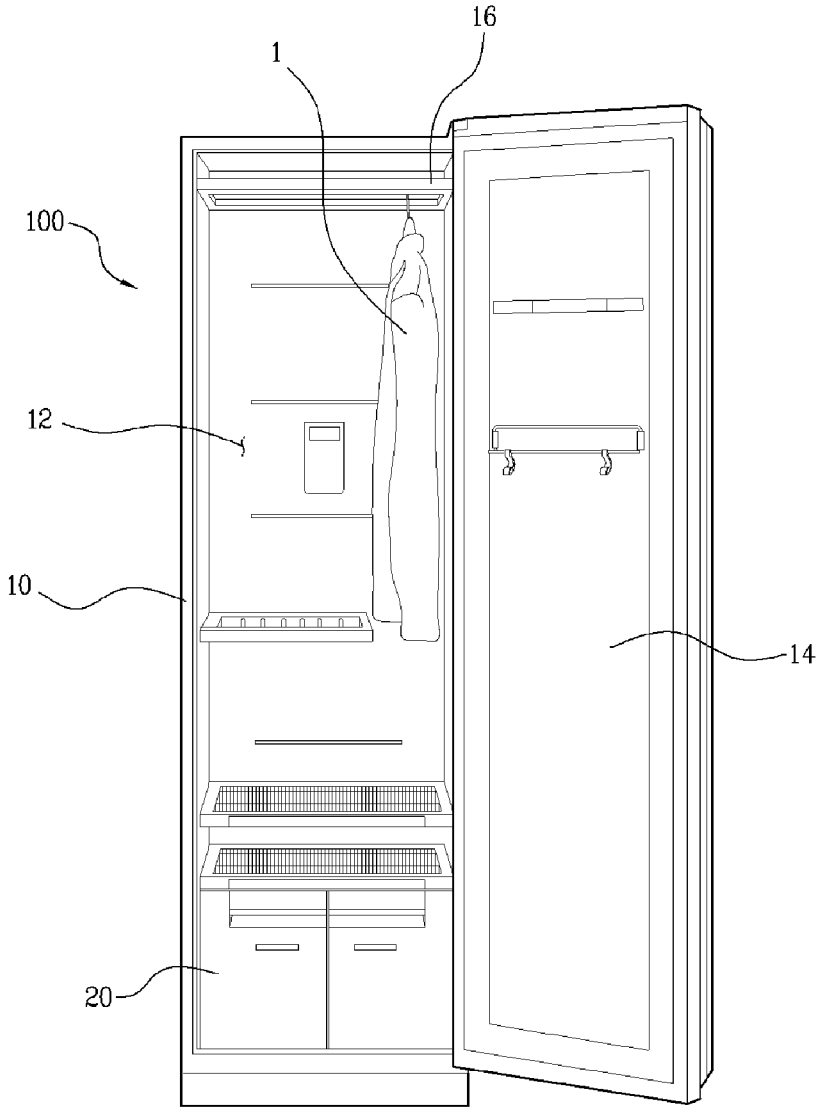
FIG. 1 is a front view illustrating a laundry treating apparatus according to an exemplary embodiment of the present invention.

FIG. 1 is a front view illustrating a laundry treating apparatus according to an exemplary embodiment of the present invention.

In reference to FIG. 1, a laundry treating apparatus 100 according to this embodiment includes a cabinet 10, a hot air supply device (22, see FIG. 2), a steam generating device (30, see FIG. 2) and a water supply part 60. The cabinet 10 includes an accommodating space 12 receiving laundry 1 therein and the hot air supply device 22 supplies hot air to the accommodating space 12. The steam generating device 30 generates and sprays steam into the accommodating space 12. Water supplied to the steam generating device 30 is stored in the water supply part 60.

In the cabinet 10 are provided various elements which will be described later and the accommodating space 12 is formed in the cabinet 10. Such the accommodating space 12 is in communication with an outside by a door 14 and it includes plural supporters 16 hanging the clothes thereto. This supporting configuration is well-known in the art the present invention pertains to and thus its detailed description will be omitted.

In a predetermined portion of the cabinet 10 may be formed a mechanism compartment 20 receiving the hot air supply device 22 and the steam generating device 30. It is preferable that the mechanism compartment 20 is positioned under the accommodating space 12 and it accommodates the hot air supply device 22 and the steam generating device 30 therein as mentioned above. The reason why the mechanism compartment 20 is positioned under the accommodating space 12 is that the hot air and steam supplied to the accommodating space 12 has property of ascending upward. As a result, it is preferable that the hot air and steam are supplied upward to the accommodating space from the mechanism compartment 20 positioned under the accommodating space 12.

Figure 2:
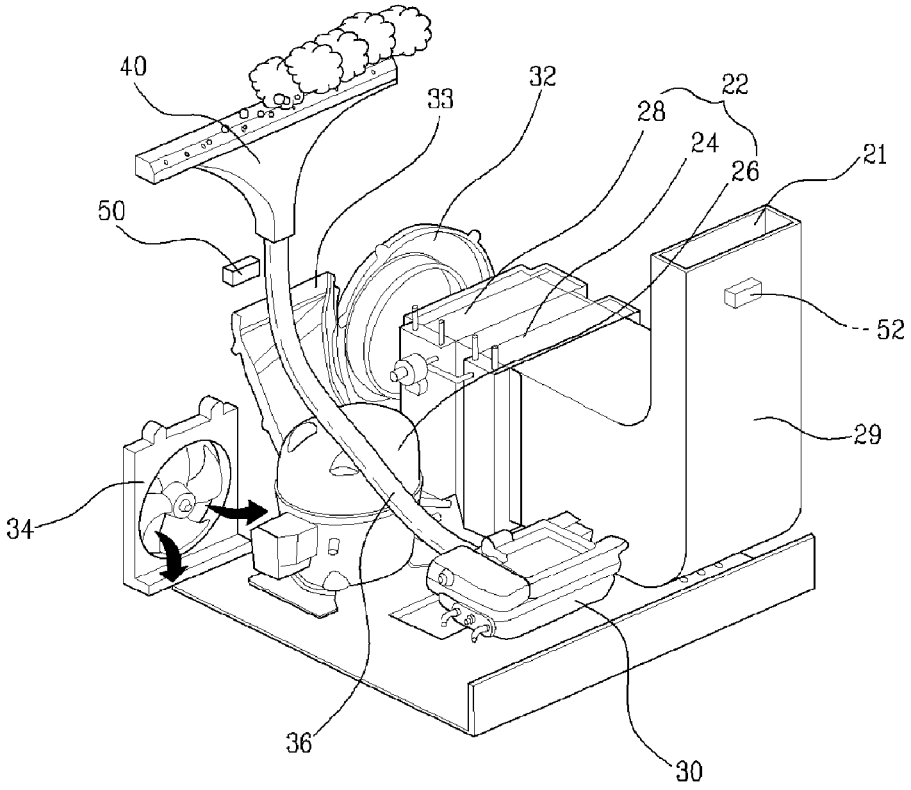
FIG. 2 is a perspective view schematically illustrating inner configuration of a mechanism compartment shown in FIG. 1.

FIG. 2 is a perspective view schematically illustrating inner configuration of the mechanism compartment 20. here, FIG. 2 shows only configuration elements composing the heat pump 22 which is a hot air supply device and the steam generating device 30 and FIG. 2 does not show a drainage line connecting the above elements each other.

In reference to FIG. 2, both the heat pump 22 as the hot air supply device supplying hot air to the accommodating space (12, see FIG. 1) and the steam generating device 30 supplying steam to the accommodating space 12 may be positioned within the mechanism compartment 20.

The heat pump 22 employed as the hot air supply device of this embodiment is similar to a heat pump useable in an air conditioner. That is, the heat pump 22 includes an evaporator 24, compressor 26, condenser 28 and expansion valve (not shown), where refrigerant passes sequentially to dehumidify and heat air. Specifically, the evaporator 24 evaporates refrigerant and absorbs latent heat of ambient air, such that the air is cooled to condense moisture contained in the air. If the refrigerant having passed the compressor 26 is condensed in the condenser 28, the latent heat is exhausted toward ambient air and the ambient air is heated. As a result, the evaporator 24 and the condenser 28 have a heat-exchanging function, such that the air supplied to the mechanism compartment 20 may be dehumidified and heated to be re-supplied to the accommodating space 12, passing the evaporator 24 and the condenser 28.

Although the temperature of the air heated by the heat pump 22 may be substantially lower than the air heated by a conventional electric heater, the air could be dehumidified without an auxiliary dehumidifier. The air re-supplied to the accommodating space 12 by the heat pump 22 may be relatively low temperature dried air. Here, the low temperature means heated air having a relatively low temperature, compared with the air conventional heated by the conventional heater, not the substantially low temperature air. Because of that, the air supplied by the heat pump 22 according to the present invention may have a low temperature, compared with the hot air supplied in the conventional laundry treating apparatus and the dehumidified air can be supplied, without any auxiliary dehumidifiers. As a result, the laundry may be dried and refreshed smoothly without difficulties.

Specifically, an inlet 21 may be formed at a top of the mechanism compartment 20 and air inside the accommodating space 12 is drawn into the mechanism compartment 20 via the inlet 21. A path may be formed by a circulation duct 29 connecting the condenser 28 and a fan 32 and the air is passed along the path. The air drawn into the mechanism compartment 20 by the circulation duct 29 via the inlet 21 may be dehumidified and heated, passing the heat pump 22, and then the air may be re-supplied to the accommodating space 12 via an outlet 33 by a fan 32.

Although not shown in the drawings, a filter may be provided at the inlet 21. The filter provided at the inlet 21 may filter various foreign substances which might be contained in the air supplied to the mechanism compartment 20 and only fresh air can be re-supplied to the accommodating space 12.

The steam generating device 30 may be provided in the mechanism compartment 20 of the laundry treating apparatus. Such the steam generating device 30 selectively supplies steam to the accommodating space 12 and wrinkles which might be generated on the laundry received in the accommodating space 12 may be removed. Moreover, high temperature steam may sterilize or bulk fabric of the laundry and then refresh the laundry. A steam spraying timing may be variable appropriately and it is preferable that steam is sprayed prior to the supply of the dried air performed by the first condensing device 22. This is because it is preferable that the laundry is dried by the dried air after spraying high temperature steam to the laundry.

Specifically, the steam generating device 30 includes a heater (not shown) heating water there inside to generate steam and the generated steam is supplied to the accommodating space 12. A water supply source supplying water to the steam generating device 30 may be an external water tap or a water supply part provided in a predetermined portion of the mechanism compartment 20. Such the water supply part may be separable from the mechanism compartment 20. The user separates the water supply source from the mechanism compartment 20 to fill up the water supply part with water and then install it back.

Figure 3:
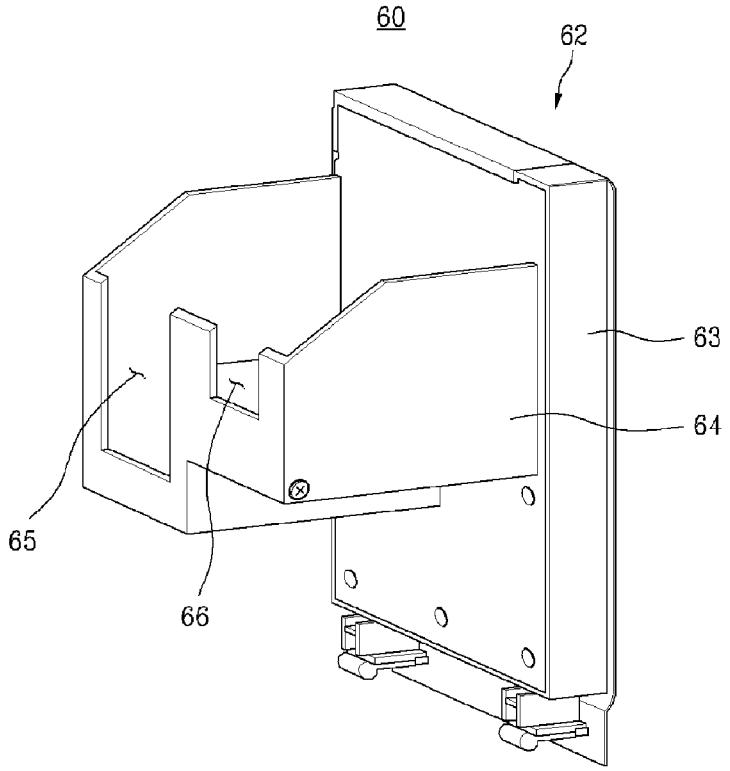
FIG. 3 is a perspective view illustrating a water supply part shown in FIG. 1.

FIG. 3 is a perspective view illustrating the water supply part detachably provided in the mechanism compartment 20 and preferably in a front of the mechanism compartment 20.

In reference to FIG. 3, the water supply part 60 may be provided in a predetermined portion of the mechanism compartment 20 and preferably detachable from the front of the mechanism compartment 20.

Specifically, the water supply part 60 includes a water supply source (70, see FIG. 4) receiving water and a case 62 forming seating space where the water supply source 70 is seated. The case 62 is detachably provided in the mechanism compartment 20. For example, the case 62 may be configured of a drawer-type sliding in the front of the mechanism compartment or a rotation-type rotatable about the front of the mechanism compartment 20 as shown in FIG. 3.

That is, the case 62 is rotatable with respect to a lower end of the front of the mechanism compartment 20. If the user fills water in the water supply part 60, the user rotates the case 62 to take out the water supply source 70 outside the mechanism compartment 20.

Within the case 62 may be formed the seating space 65 seating the water supply source 70 thereto. Specifically, the case 62 includes a body panel 64 defining the seating space 65 and a front panel 63 formed integrally with the body panel 64 to define the front of the cabinet 10, in other words, some portion of the front of the mechanism compartment 20. In this case, the water supply source 70 receiving water is seated in the seating space 65 and it supplies water to the steam generating device 30. This configuration will be described later.

In addition, an auxiliary water collecting space 66 may be formed in the body panel 64 of the case, separate from the seating space 65. The water collecting space 66 collects and holds contaminated water generated in the mechanism compartment 20 or the like. Especially, in case of adapting the heat pump as the hot air supply device according to this embodiment, condensed water would be generated by the heat exchange inside the heat pump. If it remains in the heat pump, such the condensed water would be polluted and causes bad smell and malfunction of the heat pump.

Because of that, the condensed water generated in the heat pump is collected in the water collecting space 66 and it is preferable that an auxiliary water collecting container (not shown) is further seated in the water collecting space 66 to collect the contaminated water such as the condensed water. If the condensed water is transmitted to the water collecting space 66, a pump positioned beyond the heat pump is provided to pump and transmit the condensed water to the water collecting space 66.

As a result, if the contaminated water is collected in the water collecting space 66 by the operation of the laundry treating apparatus, the user rotates and separates the case 62 and then he/she can throw out the contaminated water.

Next, a method of supplying water to the steam generating device 30 by using the water supply part 60 will be described in detail as follows.

Figure 4:
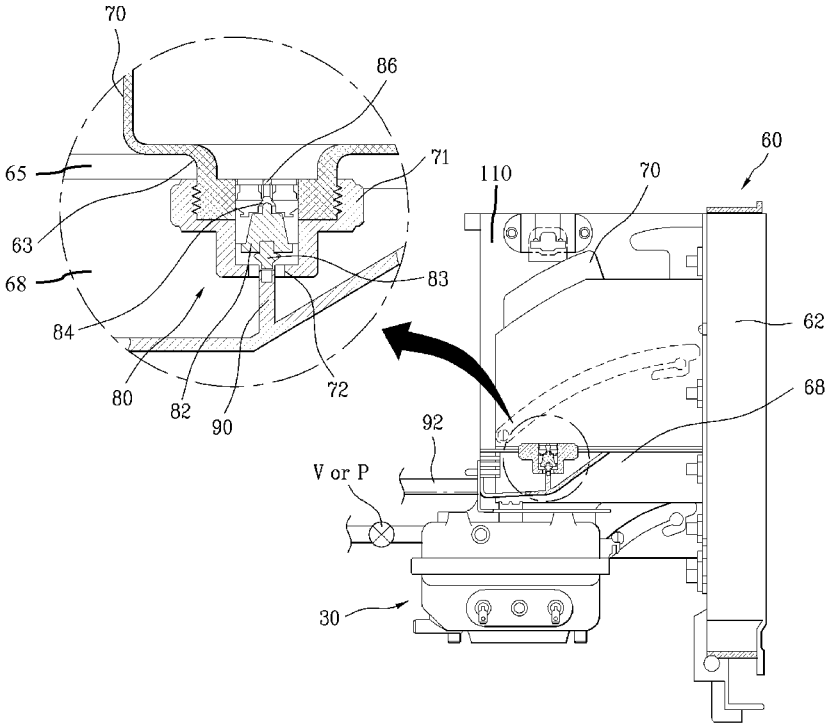
FIG. 4 and FIG. 5 are a side sectional view illustrating a water supply part and a steam generating device.
Figure 5:
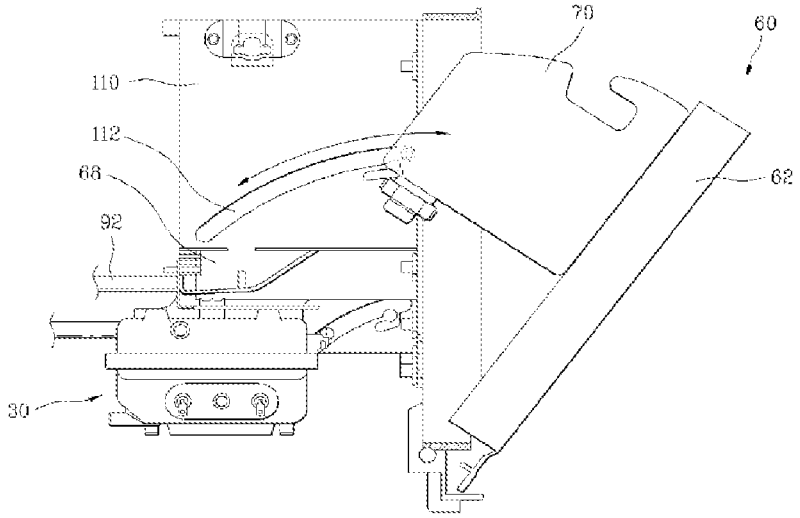

FIG. 4 illustrates a configuration in that the water supply part 60 is rotated to be installed in the mechanism compartment 20 so as to supply water to the steam generating device 30. FIG. 5 illustrates a state in that the water supply part 60 is rotated to separate from the mechanism compartment 20.

In reference to FIGS. 4 and 5, a housing 110 is provided in a predetermined portion of the cabinet 10 and the water supply part 60 is rotatably provided in the housing 110, such that the water supply part 60 may be able to be selectively inserted in the housing 110. such the housing 110 provided in the cabinet 10 has an open front through which the water supply part 60 is able to be inserted. If the water supply part 60 is rotated, a guide unit is provided to guide the motion of the water supply part 60, which will be described later.

The steam generating device 30 is mounted underneath the housing 110. specifically, a fixing part 120 is provided in the bottom of the housing 110 and the steam generating device 30 is mounted to the fixing part 120.

In the meanwhile, the water supply source 70 is seated in the seating space 65 of the case 62 of the water supply part 60. A water inlet 72 is formed in the water supply source 70, preferably, in a bottom of the water supply source 70 and the water received in the water supply source 70 is supplied to the steam generating device 30 via the water inlet 72. The water inlet 72 may include a water supply unit 80 selectively supplying water.

Specifically, an opening 63 is formed in a bottom of the seating space 65 and a tap 71 is detachably provided underneath the water supply source 70, such that the tap 71 is projected via the opening 63 in case the water supply source 70 is seated in the seating space 65. Here, the water inlet 72 may be formed in an end of the tap 71. If then, the tap 71 is installed in the bottom of the water supply source 70 perpendicularly and the water inlet 72 may be formed at the end of the tap 71.

In the meanwhile, if the water supply part 60 is positioned in the cabinet 10, the water inlet 72 may include the water supply unit 80 supplying water selectively. The water supply unit 80 includes a sealing member 82, an elastic member 84 and a supporting bar 90. The sealing member 82 is movable to close the water inlet 72 selectively and the elastic member 84 applies elasticity to the sealing member 82. The supporting bar 90 applies a force toward a predetermined direction opposite to the elasticity of the elastic member 84 according to the rotation of the water supply part 60.

That is, a supporting member 86 is provided adjacent to the water inlet 72 and an end of the elastic member 84 is supported by the supporting member and the other end is connected with the sealing member 82. This elastic member 84 is supported by the supporting member 86 and the elastic member 84 applies the elasticity toward the water inlet 72 with respect to the sealing member 82. As a result, if the water supply part 60 is detached from the cabinet 10, the sealing member 82 closes the water inlet 72 by the elasticity of the elastic member 84 such that water may not flow outside the water supply source 70.

However, if the water supply part 60 is installed in the housing 110 of the cabinet 10, the supporting bar 90 corresponding to the sealing member 82 is provided in a predetermined portion of the housing of the cabinet 10. As a result, in case the water supply part 60 is positioned in the cabinet 10, the supporting bar 90 pushes the sealing member 82 and the sealing member 82 is pushed against the elasticity such that the water inlet 72 is opened. As the water inlet 72 is open, the water inside the water supply source 70 is supplied via the water inlet 72. Also, in case the supporting bar 90 pushes the sealing member 82, more specifically, in order to push the sealing member, the sealing member 82 may include a projection portion 83 having a predetermined portion inserted in a groove 93 of the supporting bar 90.

Although the supporting bar is provided in the predetermined portion of the housing in FIG. 4, the supporting bar of the present invention may be embodied variously. For example, the supporting bar may be formed in the sealing member 82 and projected via the water inlet 72. That is, if the water supply part is installed, the supporting bar formed in the sealing member 82 is supported by the housing 110 of the cabinet 10 and the sealing member 82 is spaced apart a predetermined distance from the water inlet 72 against the elasticity such that water supply may start.

In the meanwhile, in case water is supplied to the steam generating device 30 by the water supply part 60 as mentioned above, the water supply part 60 may be provided above the steam generating device 30. If the water supply part 60 is positioned in the cabinet 10 and under the steam generating device 30, an auxiliary pump is necessary to pump the water of the water supply part upward to the steam generating device 30. This is the reason why the water supply part 60 is provided above the steam generating device 30. As a result, if the water supply part 60 is positioned in the cabinet 10 above the steam generating device 30, auxiliary members such as a pump do not have to be provided and water supply is possible only by height difference.

Alternatively, in this case, when the water inlet 72 is open, water may be supplied to the steam generating device 30 directly. However, if then, the water may be over-supplied via the water inlet 72 and water may overflow the steam generating device 30.

Because of that, intermediary space 68 may be further provided in the laundry treating apparatus according to this embodiment and the water supplied by the water supply part 60 may be received in the intermediary space temporarily before being supplied to the steam generating device 30.

Such the intermediary space 68 is provided a lower portion of the housing 110 above the steam generating device 30. Specifically, the intermediary space 68 has a kind of recess shape capable of receiving a predetermined amount of water and a path 92 connected with the steam generating device 30 may be provided in the intermediary space 68.

Thus, when the water supply part 60 is mounted to the housing 110 to start water supply via the water inlet 72 provided in the water supply part 60, supplied water is received in the intermediary space 68 initially and the water is supplied to the steam generating device 30 via the path 92 secondarily. In this case, a valve (not shown) may be provided in the path 92 to adjust the amount of water supplied to the steam generating device 30 and a bottom surface of the intermediary space 68 may be oblique downward to the path 92 such that the water may flow into the path 92 smoothly.

In case such the intermediary space 68 is provided, the supporting bar 90 provided in the cabinet 10 may be projected from the bottom surface of the intermediary space 68. In case the supporting bar 90 is formed in the sealing member 82, the supporting bar 90 is supported by the bottom surface of the intermediary space 68 such that the sealing member 82 is open.

In the meanwhile, FIG. 5 illustrates that the water supply part 60 is separated from the housing 110 after the rotation to a predetermined angle and FIG. 5 does not show the body panel 64 accommodating the water supply source 70 for explanation convenience s sake.

In reference to FIG. 5, the water supply part 60 is rotatable about the cabinet 10 as mentioned above and a guide unit guiding the motion of the water supply part 60 may guide the water supply part 60 during the rotation of the water supply part 60.

Such the guide unit may include a housing 110 having a guide groove 112 formed therein and a guide bar (not shown) corresponding to the guide groove 112.

The housing 110 may be provided in a side surface of the cabinet 10 and it is preferable that the housing 110 is provided in a front of the cabinet 10. In addition, the housing 110 may be above the steam generating device 30 as well.

The guide groove 112 guiding the motion of the water supply part 60 is provided in the housing 110, specifically, in a side or both sides of the housing 110 which the water supply part is rotated along. In case the water supply part 60 according to this embodiment rotation-moves, the guide groove 112 may formed in an arc having a predetermined semi-diameter or a simple curvature. Although not shown in the drawings, a guide bar (not shown) may be provided in the portion of the cabinet 10 forming the water supply part 60 and the guide bar is inserted in the guide groove 112 to guide the motion of the water supply part 60.

That is, if the guide bar is inserted in the guide groove 112 and the user rotates the water supply part 60, the water supply part 60 may move along the guide groove 112. Because of the guide unit, the water inlet 72 of the water supply part 60 can be rotated precisely corresponding to the supporting bar 90 of the intermediary space 68 even with the rotation of the water supply part 60.

In reference to FIG. 2 again, once water is supplied to the steam generating device 30 according to the method mentioned above, the water is heated by the heater of the steam generating device 30 and steam is generated. The generated steam is supplied to the accommodating space 12 via a steam hose 36 and a steam nozzle 40. Here, during the flow of the steam along the steam hose 36, the temperature of steam would decrease or the steam would be condensed. To prevent that, the length of the steam hose 36 may be relatively short. The shorter is the length of the steam hose 36, the more preferable is it. As a result, if the mechanism compartment 20 is positioned underneath the accommodating space 12, the steam nozzle 40 may supply steam via a top surface of the mechanism compartment 20, that is, a bottom surface of the accommodating space 12.

Furthermore, a fan 34 may be provided in a rear of the mechanism compartment 20. The fan 34 blows external air of the mechanism compartment 20 into the mechanism compartment 20 such that the temperature inside the mechanism compartment 20 may not increase too much during the operation of the heat pump 22 and the steam generating device 30.

Therefore, the laundry treating apparatus according to the present invention has this advantage. Without any auxiliary devices, water supply may be performed efficiently because the water supply unit supplying water to the steam generating device is provided above the steam generating device.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

INDUSTRIAL APPLICABILITY

Therefore, the laundry treating apparatus according to the present invention has this advantage. Without any auxiliary devices, water supply may be performed efficiently because the water supply unit supplying water to the steam generating device is provided above the steam generating device.

The invention claimed is:

1. A laundry treating apparatus comprising:

a cabinet comprising an accommodating space capable of receiving laundry and a mechanism compartment under the accommodating space;

a hot air supply device in the mechanism compartment supplying hot air to the accommodating space, the hot air supply device comprising a heat pump heating air for removing moisture contained in the air;

a steam generating device in the mechanism compartment supplying steam to the accommodating space;

a water supply part rotatably disposed in the mechanism compartment in a portion of the mechanism compartment, the water supply part capable of being moved in and out of the mechanism compartment and comprising:

a case rotatably provided in the mechanism compartment;

a water supply source storing water;

a water collecting container storing condensed water supplied from the heat pump;

a seating space in the case to support the water supply source;

a water collecting space in the case to support the water collecting container; and a water supply unit allowing water to be supplied to the steam generating device from the water supply part as the water supply part is rotated.

2. The laundry treating apparatus of claim 1, wherein the water supply source comprises a water inlet through which the water stored in the water supply source is supplied to the steam generating device, and wherein the water supply unit is in the water inlet that is perpendicularly oriented in a bottom of the water supply source.

3. The laundry treating apparatus of claim 1, wherein the case comprises a body panel where the seating space and the water collecting space are provided, and a front panel forming a portion of a front surface of the mechanism compartment, the front panel formed integrally with the body panel.

4. The laundry treating apparatus of claim 2, wherein the water supply unit opens the water inlet when the water supply part is rotated to be seated in the mechanism compartment in the seating space, and the water supply unit closes the water inlet when the water supply part is rotated to be unseated from the seating space.

5. The laundry treating apparatus of claim 4, wherein the water supply unit comprises:

a movable sealing member to open and close the water inlet;

an elastic member applying elasticity to the sealing member; and a supporting bar applying force to the sealing member when the water supply part is seated in the seating space.

6. The laundry treating apparatus of claim 5, wherein the supporting bar is provided in the sealing member.

7. The laundry treating apparatus of claim 5, further comprising an intermediary space provided between the water supply part and the steam generating device, the intermediary space storing water supplied from the water supply source before the water is supplied to the steam generating device.

8. The laundry treating apparatus of claim 7, wherein the supporting bar is provided in a predetermined portion of the intermediary space.

9. The laundry treating apparatus of claim 7, wherein the intermediary space is provided in the cabinet higher than the steam generating device.

10. The laundry treating apparatus of claim 9, further comprising a valve provided between the steam generating device and the intermediary space, the valve adjusting the amount of water supplied to the steam generating device.

11. The laundry treating apparatus of claim 7, further comprising a pump pumping the water stored in the intermediary space into the steam generating device.

12. The laundry treating apparatus of claim 1, further comprising:

a guide unit guiding the water supply part if the water supply part is rotated.

13. The laundry treating apparatus of claim 12, wherein the guide unit comprises a housing having a guide groove guiding the movement of the water supply part formed therein and a guide bar provided in the water supply part, the guide bar corresponding to the guide groove.

14. The laundry treating apparatus of claim 13, wherein the guide groove is provided in one side or both sides of the housing, along the rotation of the of the water supply part.

15. The laundry treating apparatus of claim 13, wherein the guide groove is formed in an arc shape having a predetermined radius or a curvature shape.

16. The laundry treating apparatus of claim 1, wherein the water supply source is detachable from the seating space, and wherein the water collecting container is detachable from the water collecting space.

* * * * *